United States Patent [19]

George et al.

[11] Patent Number: 4,901,802

[45] Date of Patent: Feb. 20, 1990

[54] METHOD AND APPARATUS FOR PERFORATING FORMATIONS IN RESPONSE TO TUBING PRESSURE

[76] Inventors: Flint R. George, 6118 Magnolia, Katy, Tex. 77449; Kevin R. George, P.O. Box 172, Columbus, Tex. 78934

[21] Appl. No.: 40,217

[22] Filed: Apr. 20, 1987

[51] Int. Cl.[4] ..... E21B 43/116; E21B 43/1185; F42B 3/00

[52] U.S. Cl. ..... 175/4.52; 102/312; 102/275; 102/275.11; 166/297; 175/4.54

[58] Field of Search ..... 175/4.52, 4.54; 166/55, 166/297, 63, 55.1; 102/275, 275.6, 275.11, 312, 322

[56] References Cited

U.S. PATENT DOCUMENTS

| | | | |
|---|---|---|---|
| 3,189,094 | 6/1965 | Hyde | 175/4.52 |
| 4,531,590 | 7/1985 | Peterson | 175/4.52 |
| 4,544,034 | 10/1985 | George | 175/4.52 X |
| 4,610,312 | 9/1986 | Nelson et al. | 175/4.54 X |
| 4,612,992 | 9/1986 | Vann et al. | 175/4.54 X |
| 4,616,718 | 10/1986 | Gambertoglio | 175/4.54 |
| 4,619,333 | 10/1986 | George | 175/4.52 |
| 4,629,001 | 12/1986 | Miller et al. | 175/4.52 X |
| 4,632,034 | 12/1986 | Colle, Jr. | 102/312 |

FOREIGN PATENT DOCUMENTS

| | | |
|---|---|---|
| 8614911 | 3/1987 | United Kingdom . |
| 8617971 | 7/1987 | United Kingdom . |
| PCT/GB87/-00430 | 12/1987 | United Kingdom . |

OTHER PUBLICATIONS

Vann Systems Schematic Drawing (1986).

*Primary Examiner*—Stephen J. Novosad

[57] ABSTRACT

The present invention presents a method and apparatus for perforating a well in response to fluid pressure in a first tubing string while establishing a pressure balance in response to pressure in a second string, or in the well casing, through which the well will be produced. Additionally, redundant firing heads may be provided for perforating guns utilized to assure optimal reliability of the system. One or more perforating equipment assemblies may be employed in a tool string, each of which includes redundant firing mechanisms responsive to pressure in the tool string. Additionally, a firing head assembly is utilized which is initially responsive to pressure in the tool string, but which is subsequently actuated by annulus pressure. The firing head is suitable for use with much lower annulus pressures than are utilized with conventional hydraulically actuated firing head assemblies.

13 Claims, 5 Drawing Sheets

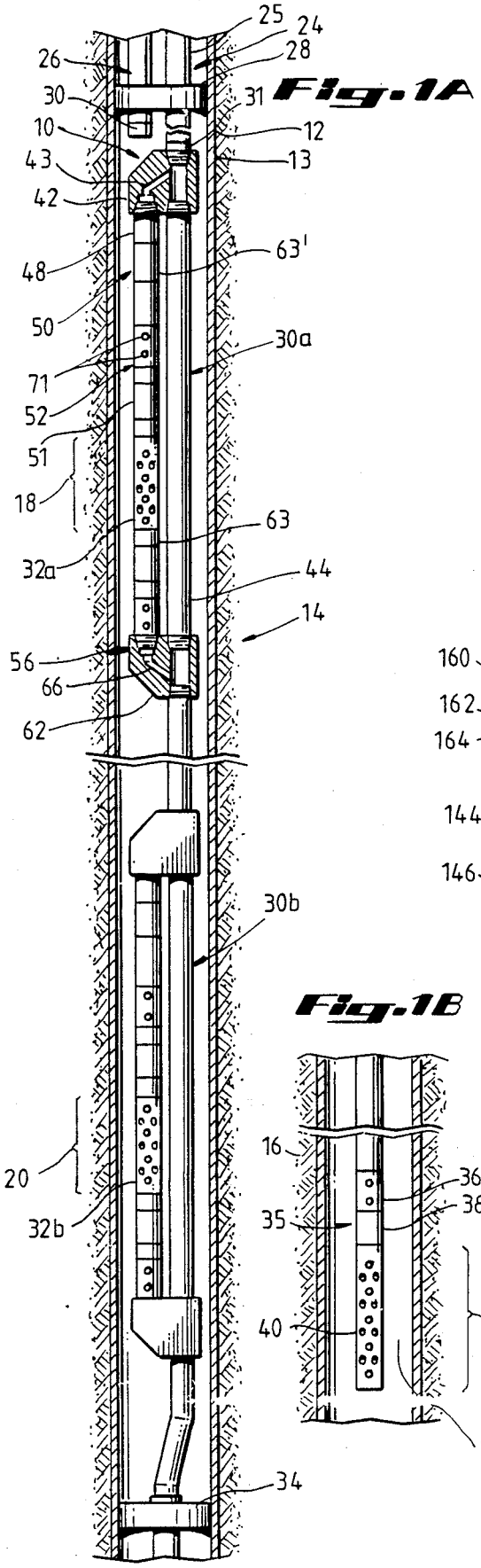
Fig. 1A
Fig. 1B
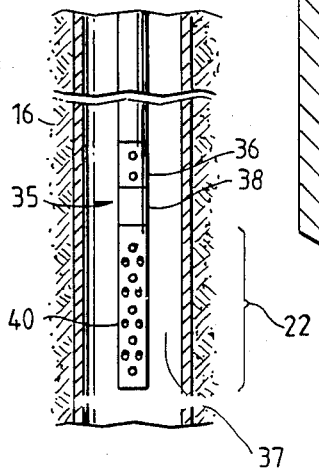
Fig. 4
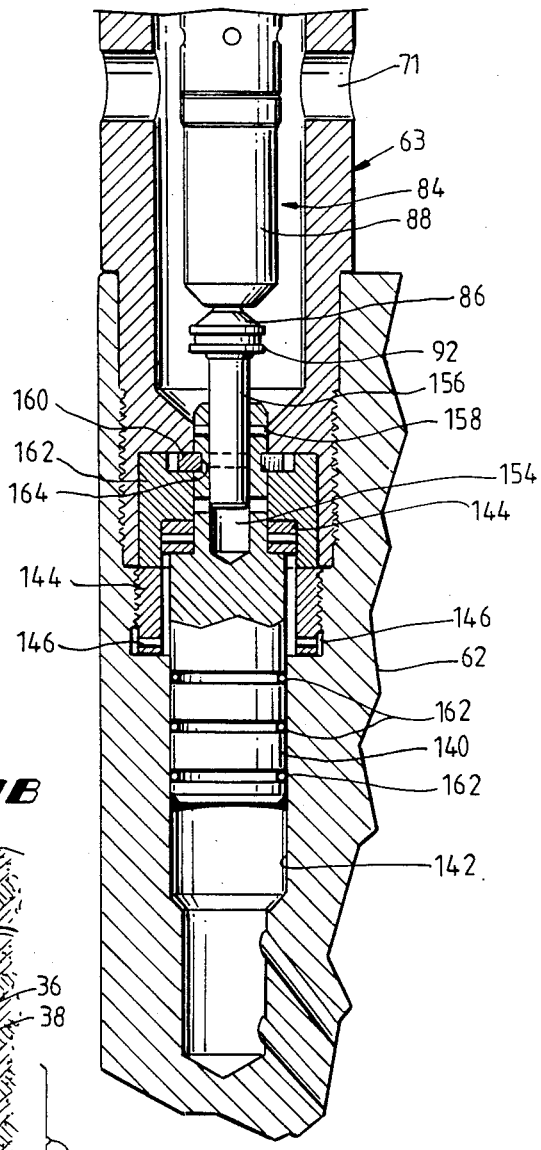

Fig. 7A
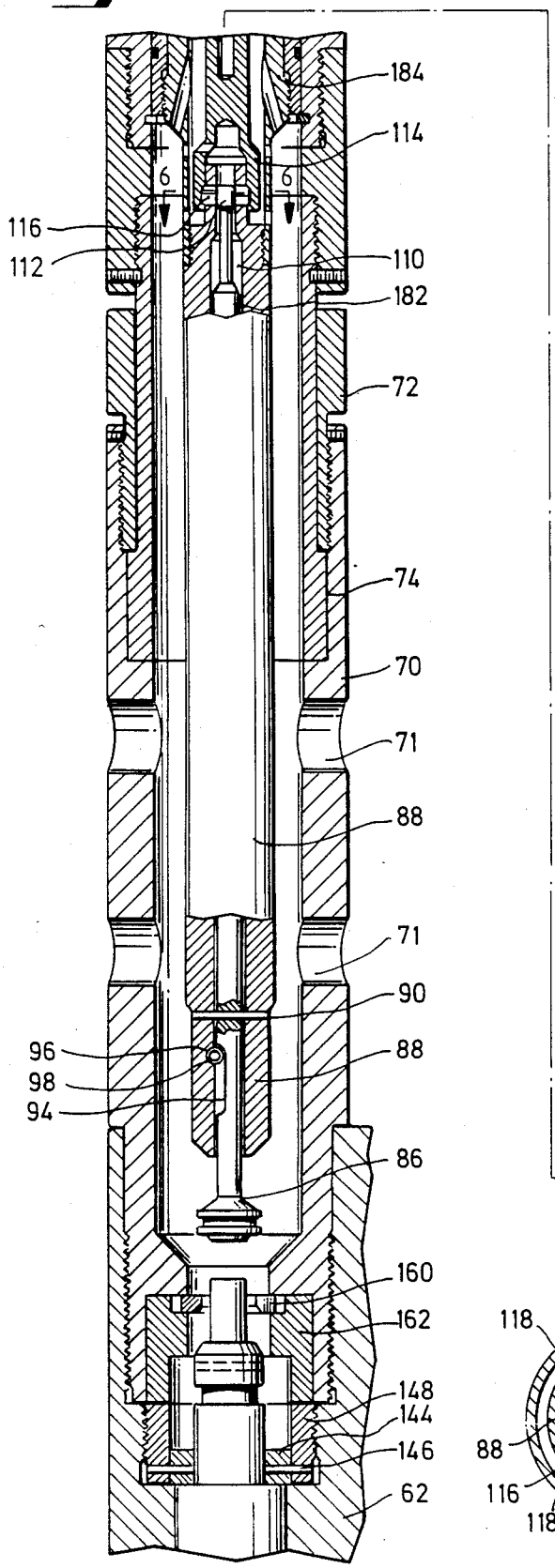
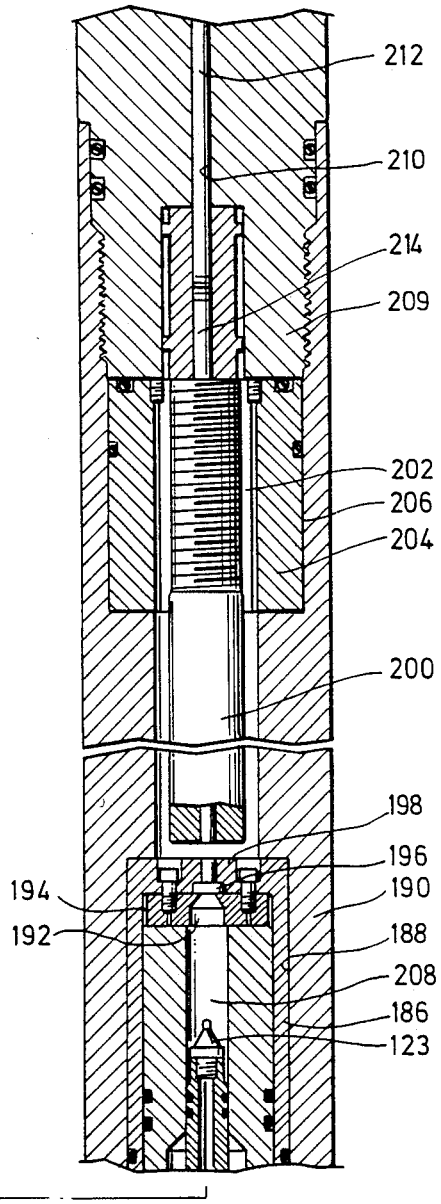
Fig. 7B
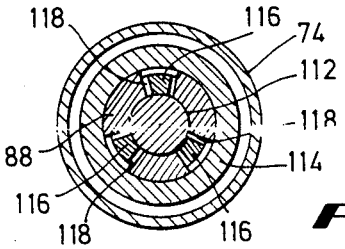
Fig. 6

METHOD AND APPARATUS FOR PERFORATING FORMATIONS IN RESPONSE TO TUBING PRESSURE

BACKGROUND OF THE INVENTION

The present invention relates generally to methods and apparatus for tubing conveyed perforating, and more specifically relates to methods and apparatus for perforating subsurface formations in response to pressure in a first tubing string and producing the formations through a second tubing string or through the casing. The present invention is particularly advantageous when multiple formations are desired to be perforated and produced together.

In oil and gas wells, it is often desirable to obtain production from multiple zones in a single well. In such wells, it may be desirable to perforate and produce from more than one formation within a single zone. Particular problems may be encountered when these formations are widely spaced. For example, it is known to perforate and produce formations located a thousand feet or more apart as a single zone. Difficulties presented in such situations include, for example, difficulties in obtaining reliable actuation of the detonating mechanism for the perforating guns, and particularly, doing so while maintaining a desired underbalance on the formations at the time of perforating.

Additionally, in many operations it is preferable to detonate the perforating guns through use of hydraulic pressure rather than by passing a mechanical detonating mechanism, such as a detonating bar, or "go devil," through the tool string. It is also preferable to utilize redundant firing mechanisms to optimize reliability of detonation of the perforating guns. Prior art techniques utilizing redundant firing mechanisms have required the pressurization of the annulus in the well adjacent the zone to be perforated. Such pressurization of the annulus can eliminate the ability to establish a desired pressure balance, typically an underbalance, between the perforated formation and the wellbore, to obtain optimal perforation of the formation.

Accordingly, the present invention provides a new method and apparatus for reliably perforating one or more formations in response to fluid pressure in a first tubing string while allowing the pressure differential between the formation and the wellbore to be established by a fluid column in a second tubing string or in the casing, through which the perforated formation may be flowed or produced. Additionally, the present invention facilitates the use of redundant firing mechanisms to maintain reliability of the perforating system. Additional formations, even when widely spaced, may be perforated without diminishing reliability of the system. Additionally, the first tubing string may be utilized to produce a second zone in the well.

SUMMARY OF THE INVENTION

In a preferred embodiment, the present invention provides an apparatus for perforating a well which includes two tool strings. The first tool string includes at least one perforating assembly. The perforating assembly preferably includes a tubing string, which defines a first fluid passageway. In a particularly preferred embodiment, the perforating assembly will include suitable apparatus for providing a second, coextensive, assembly, relative to said tubing string. This coextensive assembly will include an upper firing head coupled to the upper end of a perforating gun, and a lower firing head coupled to the lower end of the perforating gun. Each firing head will be of a type actuable by fluid pressure within the tubing. In a particularly preferred embodiment, each firing head will be of a type where a locking or retaining mechanism is released in response to pressure in the tubing string and where actual detonation of the firing head is accomplished in response to annulus pressure in the well. Additionally, a flow path for the perforated formation will preferably be established by a second tool string, which may be merely a tubing string, which extends to a location proximate the formations to be perforated. Preferably, both the first tool string and the second tool string will extend into a zone which is isolated at its upper end by a packer.

The present invention also includes the use of two or more perforating assemblies as described above in the first tool string. Additionally, the first tool string may include one or more additional packers to isolate a second zone in the well. In a preferred embodiment this arrangement would facilitate the actuation of perforating guns through pressure in the first tool string and also the flowing or production of the second zone along the passageway of the first tool string.

BRIEF DESCRIPTION OF DRAWINGS

FIGS. 1A–B depict a perforating equipment assembly in accordance with the present invention, disposed within a well, illustrated partially in vertical section.

FIG. 4 depicts the actuation mechanism of FIGS. 2B and 3B in greater detail and partially in vertical section.

FIG. 6 depicts a portion of the detonation mechanism of FIG. 5A along lines 6—6, in horizontal section.

FIGS. 7A–B depict an alternative firing head assembly in accordance with the present invention, illustrated partially in vertical section.

DETAILED DESCRIPTION OF PREFERRED EMBODIMENT

Figure 2A:
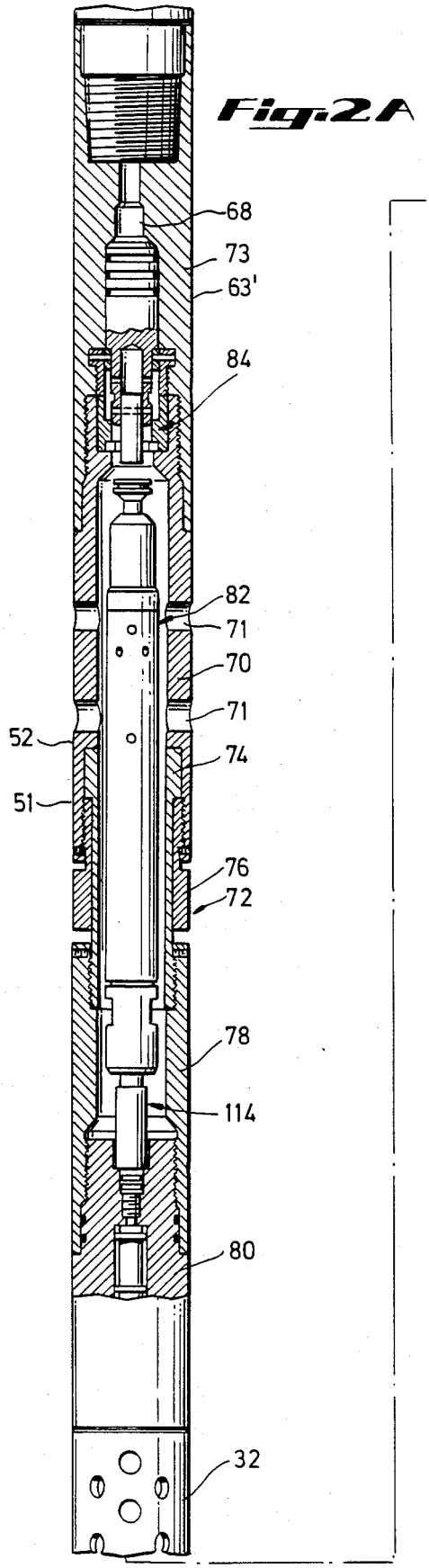
FIGS. 2A–B depict elements of perforating assemblies as shown in FIG. 1 in greater detail, and partially in vertical section.

Referring now to FIGS. 1A–B, therein is schematically depicted one example of a perforating equipment assembly 10 established in accordance with the present invention and situated inside a well 12 in which casing 13 has been set. Well 12 includes an upper zone 14 and a lower zone 16. Upper zone 14 is adjacent two spaced formations to be perforated, 18 and 20. Lower zone 16 is adjacent a single formation to be perforated 22.

Perforating equipment assembly 10 includes a long string assembly 24 and a short string assembly 26, coupled together by a dual packer 28. Dual packer 28 may be of any conventional type, and, as will be apparent from the discussion to follow, may be either mechanically or hydraulically set. Short string 26 may be simply a string of tubing coupled to dual packer 28 to form a flow path. However, for practical reasons, a nipple seating profile 30 or other closure device will preferably be provided in short string 26. It should be clearly understood that the term "tubing" as used herein may refer to drill pipe, completion tubing, production tubing or other similar tubular members suitable for forming the flow paths described and illustrated herein. Similarly, unless identified otherwise, connections between tubular or housing members will be by way of conventional "pin" and "box" threaded couplings.

Long string assembly 24 includes a tubing string 25, also coupled to dual packer 28. Coupled to tubing string 25 beneath dual packer 28 in long string assembly 24 are two perforating assemblies, indicated generally at 30*a* and 30*b*. Each perforating assembly 30*a*, 30*b* is functionally identical. A seating profile 31 for a plug may also be included in long string assembly 24. The structure of perforating assemblies 30*a* and 30*b* will preferably be essentially identical. However, as will be apparent to those skilled in the art, the length of the perforating gun or guns, indicated generally at 32*a*, 32*b*, in each perforating assembly 30*a*, 30*b* may be varied to facilitate perforation of the desired interval.

Beneath perforating assemblies 30*a* and 30*b* in long string assembly 24 is a packer 34 which isolates upper zone 14 from the lower zone 16 of well 12. Packer 34 may be either carried into the hole as an integral portion of long string assembly 24, or it may be set in the well, such as by wireline, and long string assembly 24 stabbed into it. Beneath packer 34 is a conventional perforating assembly 35 including a perforated nipple 36, a firing head 38 and a perforating gun 40. Perforated nipple 36 can be one of many conventional apparatus adapted to provide a fluid path from lower annulus 37 into long string assembly 24. As will be discussed in more detail later herein, firing head 38 is preferably a hydrulically actuated firing head. However, firing head 38 may also be a mechanically actuated firing head. As can be seen in FIG. 1, tubing string 25 extends from the surface, through both perforating assemblies, to perforating assembly 35.

Figure 2B:
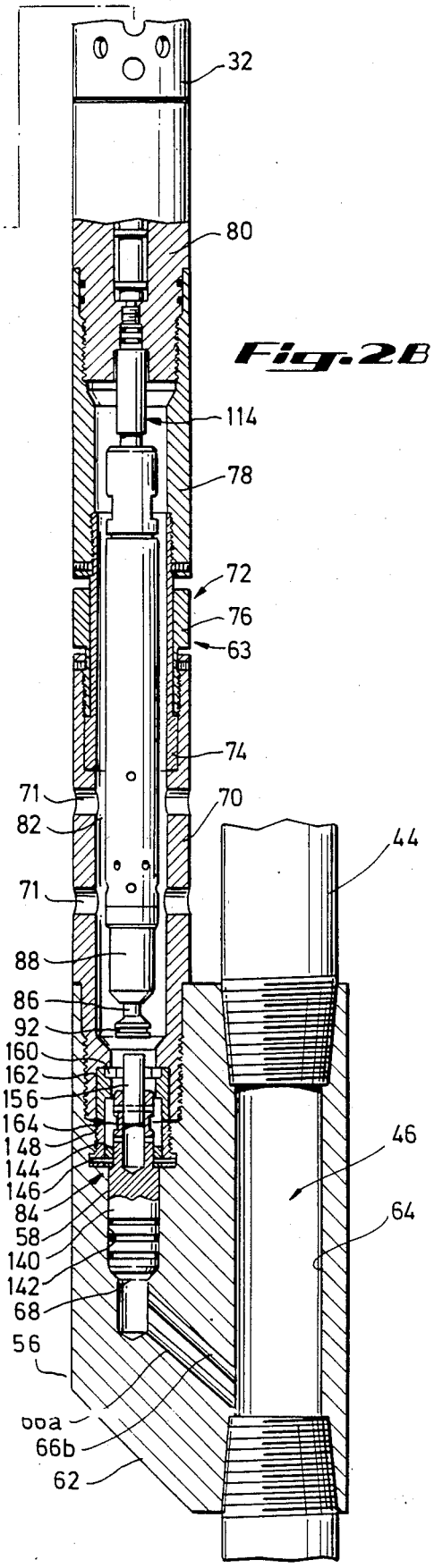

Referring now also to FIGS. 2A–B, therein are depicted portions of perforating assemblies 30 in greater detail and partially in vertical section. Each perforating assembly 30 extends from an upper branching block, or Y-block, 42 to a lower branching block assembly, or Y-assembly, 56. Y-block 42 and Y-assembly 56 facilitate the establishing of two coextensive strings. A primary string includes one or more lengths of tubing 44 which form a portion of tubing string 25. Tubing string 25 and Y-block 42 and Y-assembly 56 cooperatively define a flow path 46 throughout long string assembly 24. A secondary string includes equipment to perforate the well and components to facilitate assembly of perforating assembly 30. Coupled to Y-block 42 in the secondary string is an adapter sub 48 and a swivel 50. Swivel 50 is included to facilitate assembly of perforating assembly 30 and may be of a conventional type. Preferably, swivel 50 will be a telescoping swivel. Adapter sub 48 is included to allow the adjustment of the length of the secondary string to facilitate assembly of perforating assembly 30 Located beneath swivel 50 is firing head sub 51 which includes a firing head assembly 52. Firing head sub 51 is then coupled to perforating gun 32. At the lower extreme of perforating gun 32 is Y-assembly 56. Y-assembly 56 also includes a firing head assembly, indicated generally at 58. Y-assembly 56 contains passages 66 which form a fluid path between flow path 46 and firing head assembly 58. Similarly, Y-block 42 includes a fluid path 43 which allows communication from flow path 46, through adapter sub 48 and swivel 50, to firing head assembly 52.

Figure 3A:
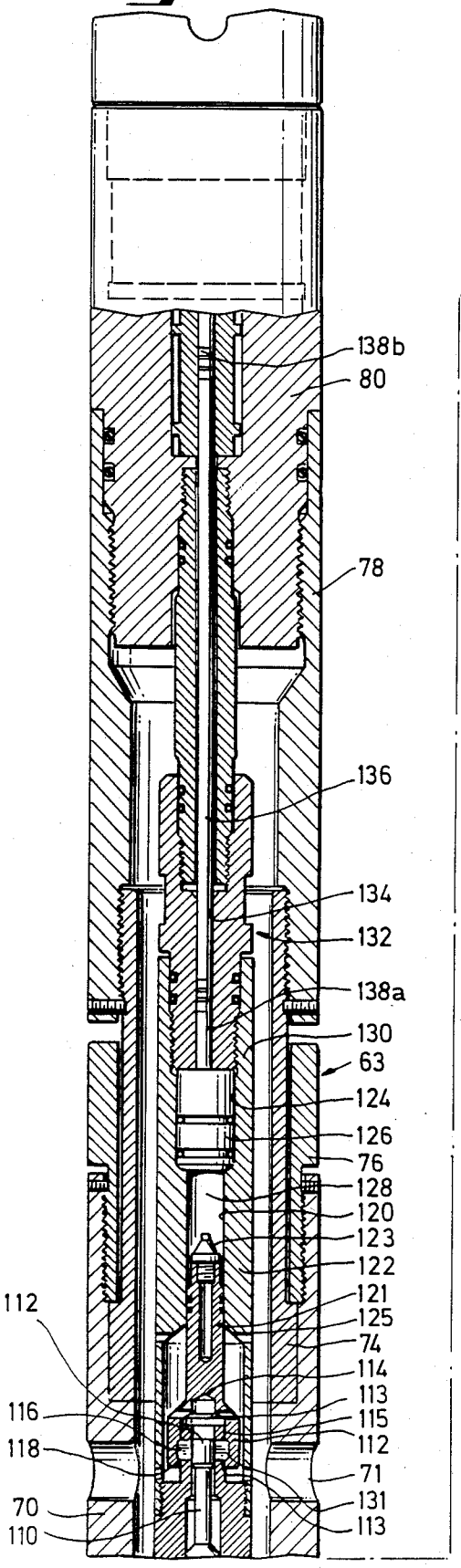
FIGS 3A–B depict a firing head assembly of FIG. 2B in greater detail and partially in vertical section.
Figure 3B:
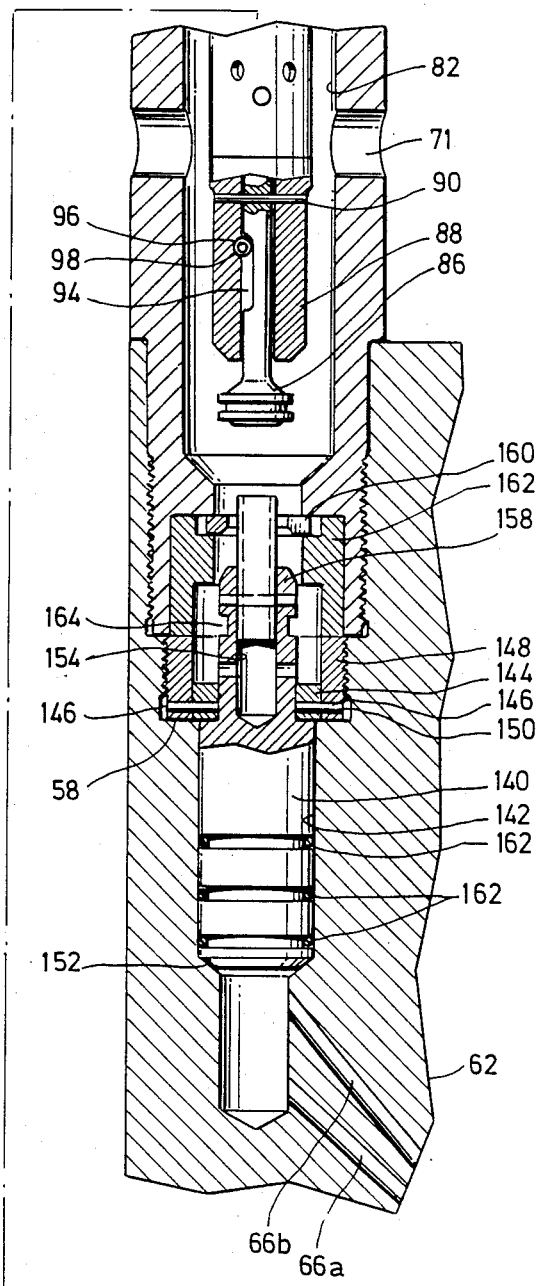

Firing head assembly 52 is depicted in FIG. 2A, while firing head assembly 58 in Y-assembly 56 is depicted in FIG. 2B, as well as in FIGS. 3A–B and 4. Firing head sub 51 and Y-assembly 56 each preferably include housing assemblies, for firing head assemblies 52 and 58, respectively. These housing assemblies include corresponding components, including swivel portions. Additionally, the operating mechanisms of firing head assembly 52 and firing head assembly 58 are preferably identical. Accordingly, only the housing and mechanism of firing head assembly 58 will be discussed herein in detail. Corresponding components in firing head sub 51 and firing head assembly 52 have been identified with identical numerals. Because both firing head assembly 52 and firing head assembly 58 are in fluid communication with flow path 46 in long string assembly 24, firing head assembly 52 and firing head assembly 58 will be responsive, essentially simultaneously, to fluid pressure in flow path 46.

Referring now primarily to FIG. 2B, therein is depicted an exemplary Y-assembly 56 in accordance with the present invention, illustrated partially in vertical section. Y-assembly 56 includes a Y-housing 62 and a firing head housing assembly, indicated generally at 63. Y-housing 62 includes conduit 64 which forms a portion of flow path 46, one or more conduits 66*a*, 66*b*, and piston chamber 68. Conduits 66*a*, 66*b* provide fluid communication between flow path 46 and piston chamber 68.

Firing head housing assembly 63, together with piston chamber 68, and their associated components form firing head assembly 58. Firing head housing assembly 63 includes a ported housing 70 which is coupled to a swivel, indicated generally at 72. Swivel 72 includes a swivel sub mandrel 74 rotatably coupled to ported sub 70 by swivel retainer 76. Swivel sub mandrel 74 couples to housing 78 which is coupled to sub 80 attached to perforating gun 32. Swivel 72 allows housing 78 and components connected thereto to rotate relative to ported sub 70 to facilitate makeup of perforating assembly 30. Ports 71 in ported sub 70 facilitate fluid communication between the well annulus surrounding housing assembly 63 and the interior of housing assembly 63. Firing head housing assembly 63', of firing head sub 51, differs from firing head housing assembly 63 in that firing head housing assembly 63' includes a sub 73 in place of Y-block 62.

In this preferred embodiment, firing head assembly 58 is responsive both to tubing string fluid pressure, in flow path 46, and to annulus pressure. Tubing pressure is utilized to unlock the firing mechanism to allow the firing pin to move to strike the initiator charge. However, annulus pressure is utilized to cause the firing pin to actually strike the initiator to cause detonation of the perforating gun.

Firing head assembly 58 includes a detonation mechanism, indicated generally at 82, responsive to an actuation mechanism, indicated generally at 84. Referring now also to FIGS. 3A–B, therein is depicted detonation mechanism 82 and actuation mechanism 84 in greater detail, and partially in vertical section. Detonation mechanism 82 includes a striking piston 86 retained within a bore 87 in housing 88. Striking piston 86 is longitudinally movable relative to housing 88 but is initially secured in a first position by a shear pin 90. Striking piston 86 includes a first end 92 adapted to receive an impact to shear shear pin 90 and cause longitudinal movement of striking piston 86 relative to housing 88. Striking piston 86 is retained within housing 88 at all times by the cooperation of a notch 94 in striking piston 86 and a pin 96 which cooperatively engages notch 94 and a recessed aperture 98 in housing 88.

Figure 5:
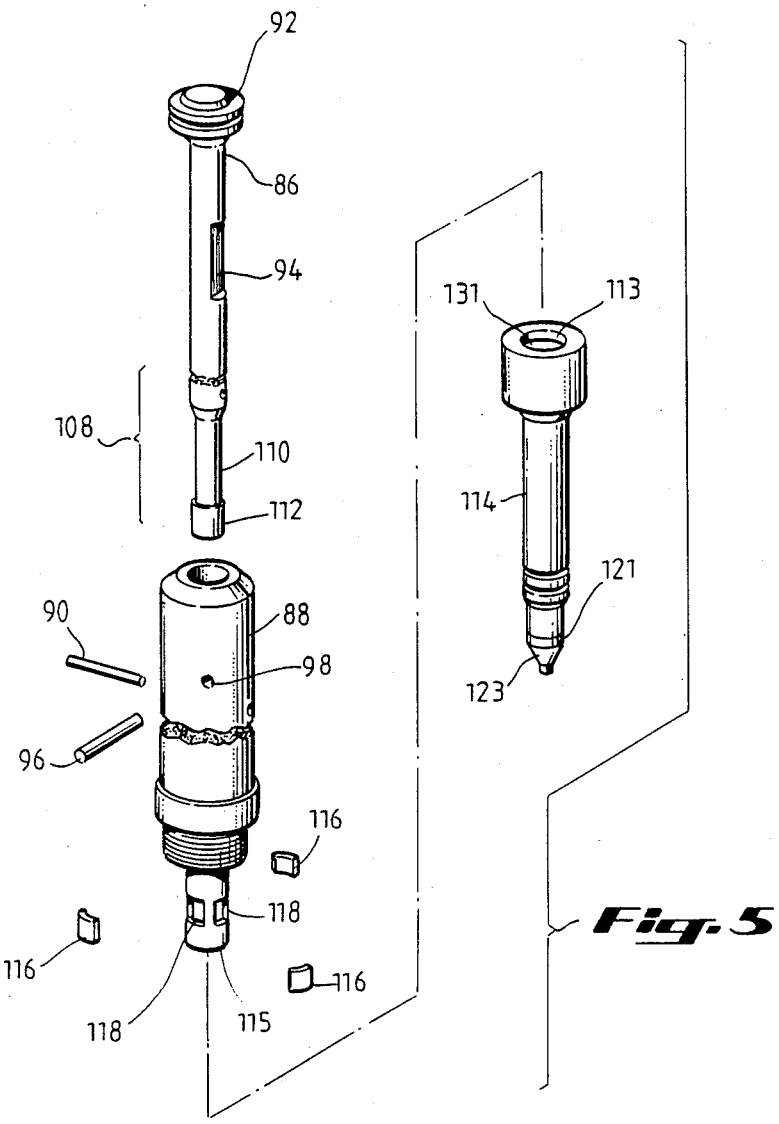
FIG. 5 schematically depicts components of the detonation mechanism of FIG. 5 in an exploded view.

Referring now also to FIGS. 3A, 5 and 6, therein are depicted portions of detonation mechanism 82 in greater detail. A second end of striking piston 86, indicated generally at 108, includes a first portion 110 of reduced diameter. Second end 108 of striking piston 86 also includes a second portion 112 of enlarged diameter relative to first portion 110 of striking piston 86. Second portion 112 of striking piston 84 and end portion 115 of housing 88 extend into a recess 113 in firing piston 114. Firing piston 114 is secured in fixed position relative to housing 88 by a plurality of collets 116 which cooperatively engage apertures 118 in housing 88 and recesses 131 in recess 113 of firing piston 114. Collets 116 are held in position by second portion 112 of striking piston 84. Second end 121 of firing piston 114 sealingly engage bore 120 in detonation extension 122, which is coupled to housing 88. A firing pin 123 is secured to second end 121 of firing piston 114. Detonation extension 122 includes ports 125 to assure fluid communication between annulus pressure and firing piston 114.

Firing pin 123 is designed to detonate an initiator charge 126 which is sealingly retained within an enlarged bore 124 in detonation extension 122. The sealing engagement of second end 121 of striking piston 114 with bore 121 and of initiator 126 with bore 124 forms a sealed chamber 128 which will be at atmospheric pressure. Accordingly, second end 121 of striking piston 114 is a fluid responsive piston within bore 120, which is responsive to annulus pressure inside housing assembly 63. Striking piston 86 will be retained by a shear pin 90 which will be selected to shear at a desired actuating pressure as created by actuation mechanism 84.

Coupled to end 130 of detonation extension 122 is a housing extension, indicated generally at 132. Housing extension 132 defines a central aperture 134 which will cooperatively provide a mechanism for communicating the ignition of initiator 126 to perforating gun 32. Preferably, aperture 134 will house a length of an explosive carrier, such as primacord, 136 fitted with a booster charge **138*a*, 138*b* at each of its ends. Housing extension 132 will preferably couple to an internal portion of sub 80 which couples, in turn, to perforating gun 32. Booster charge 138*b* will be housed in sub 80 proximate the coupling with perforating gun 32. Housing 78 couples, at an external portion, to sub 80. Referring now also to FIG. 4, therein is shown actuating mechanism 84 in the second, actuated, position. Longitudinal movement of striking piston 86 is caused by actuation mechanism 84. Actuation mechanism 84 includes an actuator piston 140 housed within piston chamber 68 of Y-housing 62. Actuator piston 140 is sealingly received in bore 142 of piston chamber 68, and is retained in bore 142 by a piston retaining ring 144. Piston retaining ring 144 is secured by shear pins 146 to an adjustable shear pin seat 148. Adjustable shear pin seat 148 is threadedly coupled, at 150, to Y-housing 62. As can be seen in FIG. 3B, actuator piston 140 is held against seating shoulder 152 by piston retaining ring 144. Threaded adjustment 150 on shear pin seat 148 facilitates the adjustment of the longitudinal placement of piston retaining ring 144 to assure that actuator piston 140 is securely seated against shoulder 152. This secure seating of actuator piston 140 will assure that pressure fluctuation in flow path 46 will not cause unwanted movement of actuator piston 140 which could lead to premature shearing of shear pins 146**.

Retained within a longitudinal bore 154 in actuator piston 140 is a telescoping firing rod 156. Firing rod 156 is held in a first longitudinal position relative to actuator piston 140 by a shear pin 158. A lock ring 160 is secured in concentric relation to the path of actuator piston 140 by a lock ring retaining member 162. Actuator piston 140 includes a peripheral groove 164. Lock ring 160 is preferably a split ring type retaining ring adapted to engage peripheral groove 164 when actuator piston 140 is moved from its resting position to a second, actuated, position, and to thereby secure actuator piston 140 in such second position.

Referring now also to FIGS. 2A and 3A, therein the actuating mechanism is depicted in greater detail. In operation, firing head assembly 58 operates as follows. Once pressure in flow path 46, and thereby in piston chamber 68 reaches a threshold level, as determined by shear pins 146, actuator piston 140 will shear shear pins 146, and will travel longitudinally toward detonating mechanism 82. Telescoping firing rod 156 will contact striking piston 86 and move it longitudinally. As striking piston 86 is moved, recessed portion 110 of striking piston 86 is brought into coextensive relation with collets 116. The reduced diameter of section 110 allows collets 116 to fall out of engagement with recesses 131 in firing piston 114. Annulus fluid pressure in housing 63, acts, through ports 125, on firing piston 114, driving it longitudinally with sufficient impact to cause firing pin 123 to ignite initiator 126. In a preferred embodiment, 1000 psi annulus pressure is sufficient to drive firing piston 114. Those skilled in the art will recognize that firing head assembly 58 may therefore be actuated by much lower annulus pressure than is required by conventional annulus pressure firing heads. Additionally striking piston 86 does not have to be shear pinned at a level above anticipated annulus hydrostatic pressure, which may be difficult to anticipate with precision.

Initiator 108 will ignite and communicate its ignition through booster charge **138*a*, primacord 136 and booster charge 138*b* to detonate a similar booster charge (not illustrated) in perforating gun 32. Accordingly, the mechanical actuation of striking piston 86 releases firing piston 114 and allows the well annulus pressure to drive firing piston 114 with a substantial force to assure sufficient impact for ignition of initiator 126. Referring now also to FIGS. 2B and 3B**, therein the actuating mechanism is shown in still greater detail.

When striking piston 86 provides an established resistance to the movement of firing rod 156, as determined by shear pin 158, shear pin 158 will shear, and telescoping firing rod 156 will move longitudinally into bore 154. When actuator piston 140 approaches the end of its range of travel, lock ring 160 will engage recess 164 in actuator piston 140 and lock it in position. Thus, telescoping firing rod 156 will be retained within bore 154, but without any solid connection by which it could apply additional force to striking pin 86. Telescoping firing rod 156 also serves as a lost motion device to avoid excessive shock to detonation mechanism 82. Similarly, actuator piston 140 will be locked in a fixed position within bore 142. Accordingly, subsequent changes in the pressure differential between the borehole annulus and in flow path 46 will not cause movement of actuator piston 140, and therefore wear of seals 162 between actuator piston 140 and bore 142. Accordingly, a secure seal will be maintained between the interior of housing assembly 63 and flow path 46.

Referring now to FIGS. 7A–B, therein is depicted an alternative embodiment of a firing head assembly, in particular a time delay firing assembly, indicated generally at 180, suitable for use with the present invention. Time delay firing assembly 180 is responsive to the same actuation mechanism 84 as used with firing head assemblies 52 and 58. Additionally, time delay firing assembly 180 utilizes a detonation mechanism, indicated generally at 182, which is substantially identical to that used in firing assemblies 52 and 58. Accordingly, corresponding components have been numbered identically. As will be apparent from the discussion to follow, in the time delay firing assembly firing pin 114 will impact a primer assembly 192 rather than an initiator. Time delay firing assembly 180 is contained within a housing assembly 181 which is preferably similar to housing assembly 63 of firing head assembly 58. As is apparent from the Figures, housing assembly 181 differs from housing assembly 63 only slightly to accommodate different internal components and to facilitate assembly.

In time delay firing assembly 180, second end 182 of housing 88 is preferably threadably coupled to a detonation block 184. Detonation block 184 is sealingly received within a sleeve 186. Similarly, sleeve 186 is sealingly received within a bore 188 in lower housing 190.

Located at the end of detonation block 184 is a primer assembly 192. Primer assembly 192 is a conventional ignition charge adapted to ignite upon impact by firing pin 123. Primer assembly 192 is secured to detonation block 184 by a primer block 194 which is preferably boltably secured to sleeve 186. Primer block 194 includes a passage 196 which allows the jet of hot gasses emitted by the ignition of primer assembly 192 to enter a chamber 198 in housing 190. Secured within chamber 198 is a delay element assembly 200. Delay element assembly 200 is preferably threadably secured at 202 to a receiving block 204 which is sealingly received within a bore 206 in housing 190. Chamber 198 and the portion of bore 208 in detonation block 184 beyond firing piston 114 will be at atmospheric pressure.

Delay element assembly 200 is a pyrotechnic device which, upon ignition of an internal initiator will burn for a period of time until detonating an explosive charge to detonate a booster charge to detonate the perforating gun. In a presently preferred embodiment, delay element assembly 200 will burn for approximately seven minutes after initial ignition. However, other delay times clearly may be utilized. The structure of a delay element assembly suitable for use with the present invention is described in U.S. Pat. No. 4,632,034 issued Dec. 30, 1986 to Colle, Jr. The specification of U.S. Pat. No. 4,632,034 is incorporated herein by reference.

Coupled to lower end of housing 190 is a sub 209 which includes a central bore 210. Sub 209 is coupled to perforating gun 32. Contained within bore 210 is a length of primacord 212 which extends through perforating gun 32 (not illustrated) and includes a booster charge 214 at first end. Booster charge 214 and primacord 212 facilitate detonation of the perforating gun in a conventional manner.

Time delay firing assembly 180 operates similarly to firing head assembly 58. Once firing piston 114 is released, firing pin 123 will impact primer assembly 192. The jet of gasses and hot particles expelled through aperture 196 by the ignition of primer 192 ignites an ignitable pellet in delay element assembly 200, initiating the time delay burn. When the burn has completed its traversal of time delay assembly 200 an explosive pellet in delay element assembly 200 will detonate, causing detonation of booster 214 and primacord 212 to detonate perforating gun 32 in a conventional manner.

Completion of a well through use of completion equipment assembly 10 may be accomplished as follows. Packer 34 may be placed in the well at a desired location between upper zone 14 and lower zone 16. Packer 34 may be set in any desired manner, such as on wireline or on drill pipe, or may be run in the well 12 as a component of long string assembly 24. If packer 34 is set independently, long string assembly 24 is then run into the well, perforating assembly 35 is stabbed through packer 34, and the string is positioned on depth. If desired, a radioactive marker may be included within long string assembly 24 and long string assembly may be positioned on depth in reference to such marker. Once the string is positioned on depth, dual packer 28 will be set. Short string 26 may then be appropriately coupled to dual packer 28, such as by stabbing into packer 28 with an appropriate seal assembly.

Where dual packer 28 is a hydraulically set packer, the packer will preferably be set in response to pressure within short string assembly 26. In such case, the packer may be tested by inserting a plug 33 into profile 30 to close the short string bore through dual packer 28 and by applying pressure in short string 26. Subsequently, the plug 33 may be removed, and pressure may again be applied down short string 26 to test the packer. As another alternative, where dual packer 28 is to be set in response to pressure in long string assembly 24, it may be desirable to include a profile 31 engagable with a plug in long string assembly 24 such that pressure in long string 24 may be restricted to tubing situated above perforating assemblies **30*a* and 30*b*** during the packer setting operation.

Because upper zone 14 will be produced through short string 24, underbalance, or overbalance, on upper zone 14 may be established by a desired fluid column in short string 26. The desired under or overbalance may be established by conventional techniques such as locating the desired fluid column in short string 26 as it is placed in the well, or by swabbing, etc. The only pressure requirement for operating perforating assemblies **30*a* and 30*b* is that there be a threshold hydrostatic pressure at the depth of upper perforating assembly 30 which is sufficient to actuate the piston of the firing assembly utilized once the piston has been released in response to pressure in long string 24**.

When it is desired to perforate upper zone 14, a first pressure may be established in long string assembly 24. This first pressure will be the threshold pressure necessary to shear shear pins 106 in the firing head subs 51 and firing head assemblies 58 in each perforating assembly **30*a* and 30*b***. As described with respect to the firing head assemblies, when the threshold pressure is achieved, the striking piston of each firing head assembly will move allowing the annulus hydrostatic pressure to drive the annulus pressure responsive piston, causing detonation of the initiator charge, and consequently, detonation of the perforating guns.

When the perforating guns detonate and the formation and casing are perforated, the flow of the formations will be determined by the pressure established in short string 24. Accordingly, there is no need to bleed off pressure from long string 24 or to perform any mechanical manipulations to allow upper zone 14 to flow or produce freely.

In a particularly preferred embodiment, lower zone 16 will be perforated subsequent to upper zone 14. When it is desired to perforate lower zone 16, a second, greater, pressure may be established in long string 24 which will actuate a hydraulic firing head 38 in perforating assembly 35 to detonate perforating gun 40. Lower zone 16 may then be flowed or produced independently of upper zone 14 through long string 24.

Many modifications and variations may be made in the techniques and structures described and illustrated herein without departing from the spirit and scope of the present invention. For example, the firing head assemblies in each perforating assembly may be adapted to detonate at different pressures in long string 24. In such an embodiment, the perforating assemblies may be selectively activated to perforate formations in the zone. Accordingly, it should be clearly understood that the embodiments described and illustrated herein are exemplary only and are not to be considered as limitations on the scope of the present invention.

What is claimed is:

1. An apparatus for perforating a well, comprising:
- a packer;
- a first tool string extending through said packer and including at least one perforating assembly, said perforating assembly comprising,
  - a tubing string;
  - a first firing head assembly in fluid communication with said tubing string,
  - a second firing head assembly in fluid communication with said tubing string,
  - a perforating gun assembly including at least one perforating gun, said assembly operatively coupled proximate one end to said first firing head and operatively coupled proximate a second end to said second firing head; and
- a second tool string providing a passageway for the flow of fluid from a location beneath said packer to the surface.

2. The apparatus of claim 1, wherein said packer is a dual packer and wherein said second tool string is operatively coupled to said packer.

3. An apparatus for perforating a well, comprising:
- a first tool string, comprising,
  - a tubing string,
  - a dual packer in said tubing string,
  - a first branching block in said tubing string for establishing a string of equipment coextensive with a portion of said tubing string,
  - a first firing head assembly operatively coupled to said first branching block, said first firing head assembly responsive to fluid pressure in said tubing string,
  - a perforating gun operatively coupled proximate one end to said first firing head assembly,
  - a second firing head assembly operatively coupled proximate a second end of said perforating gun, said second firing head assembly responsive to fluid pressure in said tubing string,
  - a second branching block coupled in said tubing string, said second branching block also coupled to said second firing head assembly; and
- a second tool string coupled to said dual packer to provide a fluid path from beneath said packer to the surface.

4. The apparatus of claim 3, wherein each of said first and second firing head assemblies are responsive initially to fluid pressure in said tubing string of said first tool string, and are subsequently responsive to fluid pressure outside said first tool string.

5. The apparatus of claim 4, wherein each of said first and second firing head assemblies comprises:
- an actuator mechanism responsive to fluid pressure in said first tool string; and
- a detonation mechanism comprising,
  - a securing assembly, said securing assembly releasable by said actuator mechanism, and
  - a piston mechanism responsive to fluid pressure in the well surrounding said firing head assembly.

6. A firing head for a perforating gun, comprising:
- a housing including first and second chambers and adapted to be positioned within a well, said first chamber in fluid communication with a tubing string and said second chamber in fluid communication with said well surrounding said firing head;
- an actuator piston movably responsive to fluid pressure in said first chamber in said housing; and
- a detonation assembly, comprising,
  - a striking piston,
  - a locking assembly means for retaining said striking piston in a first position in said housing, said locking assembly releasable by movement of said actuating piston, and
  - means for causing movement of said striking piston from said first position to a second position in response to pressure in said second chamber of said housing after said locking assembly is released.

7. The firing head of claim 6, wherein said means for causing movement of said striking piston in response to pressure in said second chamber comprises a third chamber on one side of a portion of said striking piston, said third chamber at generally atmospheric pressure.

8. A method for perforating a well and a formation surrounding said well, comprising the steps of:
- establishing a first tool string in said well, said tool string comprising,
  - a tubing string,
  - a first firing head responsive to fluid pressure in said tubing string,
  - a second firing head responsive to fluid pressure in said tubing string, and
  - a perforating gun operatively coupled proximate one end to said first firing head and operatively coupled proximate second end to said second firing head;
- establishing a second tool string in said well;
- establishing a pressure in said well adjacent said zone to be perforated through use of said second tubing string; and
- causing said first and second firing heads to be actuated by establishing a fluid pressure in said first tool string.

9. The method of claim 8, wherein said first tool string further comprises a first packer located in said well above said formation to be perforated, and wherein said second tool string provides a flow path from beneath said first packer to the surface

10. The method of claim 9, wherein said first tool string further comprises:
- a second packer located beneath said first zone to be perforated;

a perforating gun coupled beneath said second packer;

a firing head operatively coupled to said perforating gun; and a ported member to establish a flow path from beneath said second packer into said first tool string.

11. The method of claim 9, wherein said first tool string further comprises:

a third firing head responsive to fluid pressure in said tubing string;

a fourth firing head responsive to fluid pressure in said tubing string; and a second perforating gun operatively coupled proximate one end to said third firing head and operatively coupled proximate a second end to said fourth firing head.

12. An apparatus for perforating a well, comprising:

a first packer;

a first tool string extending through said first packer, said first tool string comprising, at least one perforating assembly, said perforating assembly comprising, a tubing string, a first firing head assembly in fluid communication with said tubing string, a second firing head assembly in fluid communication with said tubing string, and a first a perforating gun assembly including at least one perforating gun, said first perforating gun assembly operatively coupled proximate one end to said first firing head and operatively coupled proximate a second end to said second firing head, a second packer, said second packer located beneath said perforating assembly;

a second perforating gun assembly coupled beneath said second packer;

means operatively coupled to said second perforating gun assembly for activating said second perforating gun assembly; and a ported member coupled in said first tool string to provide a flow path from beneath said second packer into said first tool string; and a second tool string providing a passageway for the flow of fluid from a location below said first packer to the surface.

13. An apparatus for perforating a well, comprising:

a packer;

a first tool string extending through said packer comprising, a first perforating assembly comprising, a tubing string, a first firing head assembly in fluid communication with said tubing string, a second firing head assembly in fluid communication with said tubing string, and a first perforating gun assembly including at least one perforating gun, said first perforating gun assembly operatively coupled proximate one end to said first firing head assembly and operatively coupled proximate a second end to said second firing head assembly;

a second perforating assembly comprising, a third firing head assembly in fluid communication with said tubing string, a fourth firing head assembly in fluid communication with said tubing string; and a second perforating gun assembly including at least one perforating gun, said second perforating gun assembly operatively coupled proximate one end to said third firing head assembly and operatively coupled proximate a second end to said fourth firing head assembly.

* * * * *

UNITED STATES PATENT AND TRADEMARK OFFICE

CERTIFICATE OF CORRECTION

PATENT NO. : 4,901,802

DATED : February 20, 1990

INVENTOR(S) : Flint R. George et al.

It is certified that error appears in the above-identified patent and that said Letters Patent is hereby corrected as shown below:

On the title page, please add the following:

--Halliburton Company--.

Signed and Sealed this

Twentieth Day of October, 1992

*Attest:*

DOUGLAS B. COMER

*Attesting Officer*

*Acting Commissioner of Patents and Trademarks*